US012116993B2

(12) United States Patent
Mou et al.

(10) Patent No.: US 12,116,993 B2
(45) Date of Patent: Oct. 15, 2024

(54) FLUID PUMP MODULE

(71) Applicant: Microjet Technology Co., Ltd., Hsinchu (TW)

(72) Inventors: Hao-Jan Mou, Hsinchu (TW); Ching-Sung Lin, Hsinchu (TW); Chih-Kai Chen, Hsinchu (TW); Yung-Lung Han, Hsinchu (TW); Chi-Feng Huang, Hsinchu (TW); Tsung-I Lin, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 99 days.

(21) Appl. No.: 17/941,755

(22) Filed: Sep. 9, 2022

(65) Prior Publication Data

US 2024/0018957 A1 Jan. 18, 2024

(30) Foreign Application Priority Data

Jul. 18, 2022 (TW) ..... 111126902

(51) Int. Cl.
*F04B 53/06* (2006.01)
*F04B 43/04* (2006.01)
(Continued)

(52) U.S. Cl.
CPC ..... *F04B 53/08* (2013.01); *F04B 43/046* (2013.01); *F04B 53/16* (2013.01)

(58) Field of Classification Search
CPC ..... F04B 53/16; F04B 43/046; F04B 53/08
See application file for complete search history.

(56) References Cited

U.S. PATENT DOCUMENTS

2004/0021398 A1* 2/2004 East ..... H10N 30/2047 29/25.35
2009/0060762 A1* 3/2009 Ishikawa ..... F04B 43/046 310/317

(Continued)

FOREIGN PATENT DOCUMENTS

CN 102224342 A 10/2011
CN 113614374 A 11/2021

(Continued)

OTHER PUBLICATIONS

"MatWeb, Overview of materials for Stainless Steel, Nov. 12, 2020, MatWeb" (Year: 2020).*

(Continued)

*Primary Examiner* — Connor J Tremarche
(74) *Attorney, Agent, or Firm* — Birch, Stewart, Kolasch & Birch, LLP

(57) ABSTRACT

A fluid pump module includes a heat dissipation board assembly, a fixing frame body, fluid pumps, a control board and a conveying pipe is provided. The fixing frame body is fixed at one side of the heat dissipation board assembly, so as to form two accommodating spaces between the heat dissipation board assembly and the fixing frame body. Two fluid pumps are respectively disposed in the two accommodating spaces. The control board is disposed at another side of the heat dissipation board assembly. The conveying pipe connects the two fluid pumps in series so as to form a series connection therebetween. The control board controls operations of the fluid pumps, and the heat dissipation board assembly dissipates heats produced by a module formed by the two fluid pumps.

15 Claims, 7 Drawing Sheets

(51) Int. Cl.
*F04B 53/08* (2006.01)
*F04B 53/16* (2006.01)

(56) References Cited

U.S. PATENT DOCUMENTS

| | | | | |
|---|---|---|---|---|
| 2011/0296722 | A1* | 12/2011 | Lukas | F04B 43/095 38/77.1 |
| 2020/0318630 | A1* | 10/2020 | Kondo | F04B 43/046 |
| 2021/0324851 | A1* | 10/2021 | Yamanaka | F04B 39/121 |

FOREIGN PATENT DOCUMENTS

| | | | |
|---|---|---|---|
| CN | 114127420 | A | 3/2022 |
| EP | 2 930 363 | A1 | 10/2015 |
| JP | 2016-200067 | A | 12/2016 |

OTHER PUBLICATIONS

Extended European Search Report for European Application No. 22202680.9, dated May 23, 2023.

* cited by examiner

FLUID PUMP MODULE

FIELD OF THE INVENTION

The present disclosure relates to a fluid pump module, and more particularly to a fluid pump module with a core module for transporting a fluid.

BACKGROUND OF THE INVENTION

Currently, all kinds of products used in various fields, such as pharmaceutical industries, computer techniques, printing industries or energy industries, are developed in the trend of elaboration and miniaturization. Among these, products, such as mini pumps, micro atomizers, printheads or industrial printers, generally employ a fluid transportation device, and the micro pump used therein as a driving core is an essential component of the fluid transportation device. Therefore, how to break through the technical bottleneck by providing innovative structures of the micro pump and the fluid transportation device is the crucial issue of development. With the rapid advancement of science and technology, the applications of fluid transportation device are more and more diversified, for example, the fluid transportation device can be utilized in industrial applications, biomedical applications, healthcare, electronic cooling, even the most popular wearable devices and so on. As the result, the conventional fluid transportation devices gradually tend to miniaturize the structure and maximize the flow rate thereof.

However, although the trend for the development of the fluid transportation device is maximizing the flow rate thereof, the design of the structure for the fluid transportation device still has to consider some issues, such as heat dissipation, stability, endurance performance, and vibration suppression, of the micro pump itself during operation while maintaining a sufficient flow rate. The issues described above are even more important when the fluid transportation device is employed in the biomedical and healthcare applications since such issues mentioned above might significantly affect the using experience and the comfort level for the user.

Accordingly, take the electric breast pump, described in Taiwan Patent Nos. I724630B and M503225U, as an example of the application of the fluid transportation device in the healthcare field. The structure of current commercial electric breast pump generally includes a breast suctioning shield, a breast milk collection bottle, a guiding tube, a driving pump, a control circuit and a battery. The power for the overall device is provided by the battery for operation. The breast suctioning shield is used by attaching to the breast of the user while a driving signal is transmitted from the control circuit to the driving pump to produce a suctioning force, and the breast milk can be guided to the breast milk collection bottle via the guiding tube for storage, thereby achieving the purpose of assisting the user in collecting the breast milk thereof.

However, the discussion regarding to the configuration of the fluid transportation device itself, the formality of the fluid pump in fluid transportation device and how to install the fluid pump in the device adopting it are rare. Take the electric breast pump mentioned above as an example, if the efficacy in heat dissipation, stability, endurance performance, and vibration suppression during the operating of operation core, i.e. the fluid pump itself, is insufficient, the comfortability and spending time thereof may not fulfill the requirement of the user. All these issues above are highly related with the installation manner of the fluid pump utilized in the device. Accordingly, there still has a need to improve the performance of the fluid pump utilized in the current device, e.g. the electric breast pump and devices in other fields of industrial application like biomedical application, healthcare, and electronic cooling, to achieve the intended purpose thereof.

SUMMARY OF THE INVENTION

The object of the present disclosure is to improve the efficacy of the conventional fluid pump, such as heat dissipation, stability, endurance performance, and vibration suppression, as being installed in the device utilizing the fluid pump while ensuring a sufficient flow supply of the fluid simultaneously. Notably, the fluid pump module described in the present disclosure can be installed in all kinds of devices utilizing the fluid pump, e.g., electric breast pumps, liquid filters, fluid filters, fresh air fans, hair dryers, in various fields, such as the industrial application, the biomedical application, the healthcare, and the electronic cooling.

Accordingly, the present disclosure provides a fluid pump module with a novel configuration. The fluid pump module includes a heat dissipation board assembly, a fixing frame body, fluid pumps, a control board and a conveying pipe. The fixing frame body is fixed at one side of the heat dissipation board assembly, so as to form two accommodating spaces between the heat dissipation board assembly and the fixing frame body. Two fluid pumps are disposed in the two accommodating spaces respectively. The control board is disposed at another side of the heat dissipation board assembly. The conveying pipe connects with the two fluid pumps so as to form a series connection therebetween. The control board controls the operation of the fluid pumps, and the heat dissipation board assembly dissipates heats produced by a module formed by the two fluid pumps.

BRIEF DESCRIPTION OF THE DRAWINGS

The above contents of the present disclosure will become more readily apparent to those ordinarily skilled in the art after reviewing the following detailed description and accompanying drawings, in which.

DETAILED DESCRIPTION OF THE PREFERRED EMBODIMENT

Figure 1A:
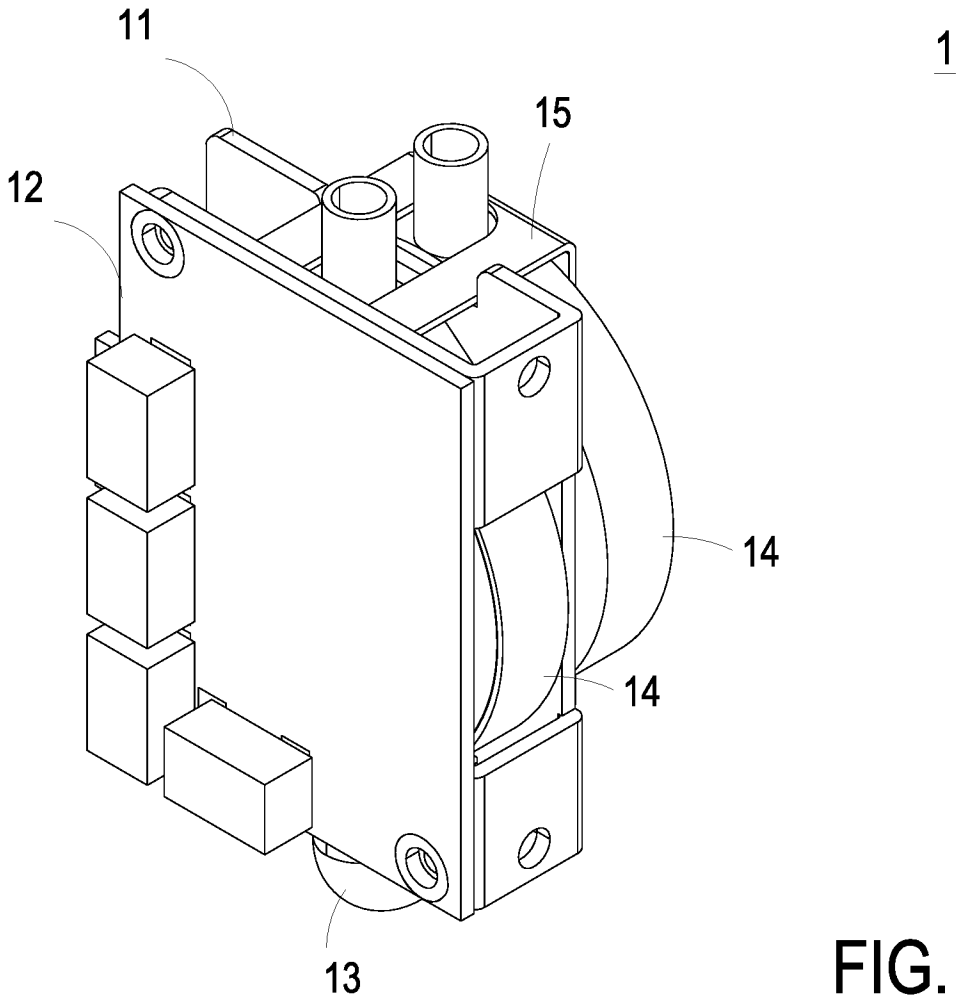
FIG. 1A is a schematic view showing the configuration of the fluid pump module according to an embodiment of the present disclosure.
Figure 1B:
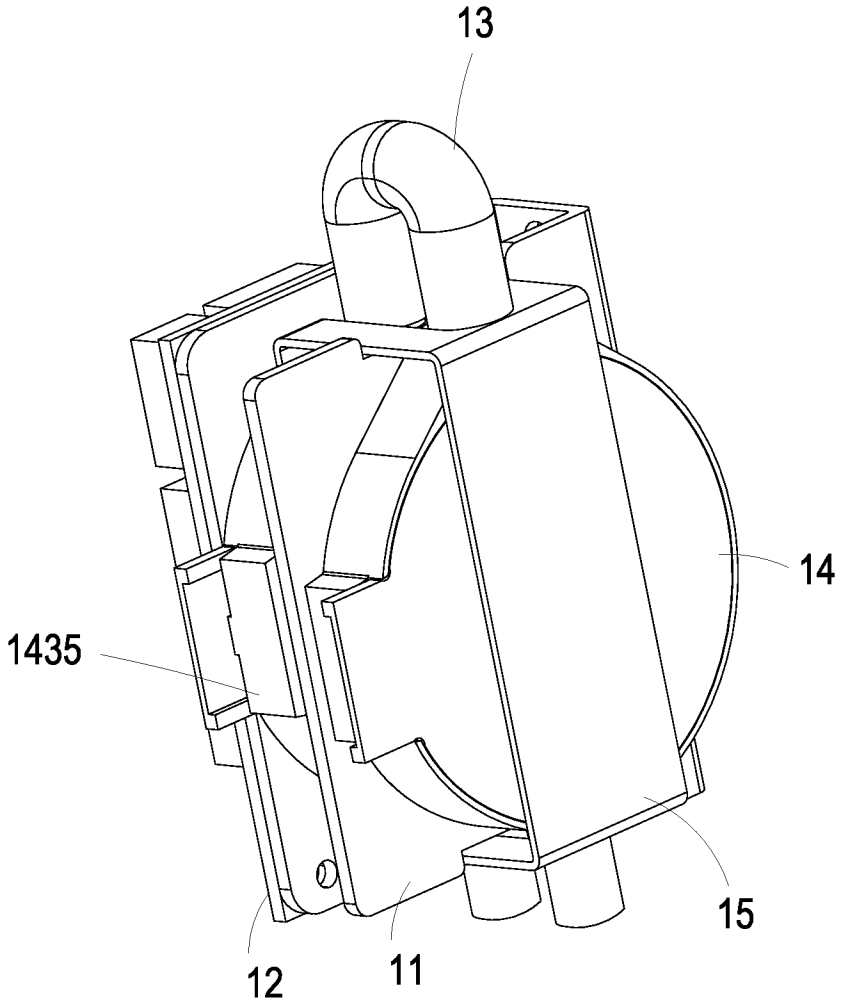
FIG. 1B is a schematic view showing the configuration of the fluid pump modules from another view angle according to the embodiment of the present disclosure.

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Please refer to FIG. 1A, FIG. 1B, FIG. 2, FIG. 3A and FIG. 3B. In order to solve the problems resides in the prior art, a fluid pump module 1 is provided in the present disclosure. In a preferred embodiment, the fluid pump module 1 includes a heat dissipation board assembly 11, a control board 12, a conveying pipe 13, two fluid pumps 14 and a fixing frame body 15. The heat dissipation board assembly 11 includes a plurality of heat dissipation flat boards 111 and a heat dissipation lateral board 112. In this embodiment, one end of each of the two heat dissipation flat boards 111 are both connected with the heat dissipation lateral board 112 to form a "⊏" shape structure. The heat dissipation board assembly 11 is made of a material with good thermal conductivity, such as metal. The fixing frame body 15 is fixed at one side of the heat dissipation board assembly 11, so as to form two accommodating spaces 113 between the heat dissipation board assembly 11 and the fixing frame body 15. The two fluid pumps 14 are respectively disposed in the two accommodating spaces 113 in a mirror symmetrical arrangement. One of the heat dissipation flat boards 111 is sandwiched between the two fluid pumps 14 so as to form a sandwich structure. The control board 12 is disposed at another side of the heat dissipation board assembly 11. The conveying pipe 13 connects and is in fluid communication with the two fluid pumps 14 so as to form a series connection therebetween. The control board 12 controls the operation of the two fluid pumps 14, and the heat dissipation board assembly 11 dissipates heats produced by a module formed by the two fluid pumps 14. In the present disclosure, the control board 12 may include, but not limited thereto, a processor, a memory, a temporary memory, a network communication module, a router, an I/O device, an operating system and/or an application program, which are electrically connected with each other through a known manner so as to perform the operation of calculation and storage, based on the practical requirements. The control board 12 transmits a driving signal for controlling the operation or the status of the fluid pump module 1 to a near remote end, so as to manage and coordinate the components of the fluid pump module 1.

Figure 2:
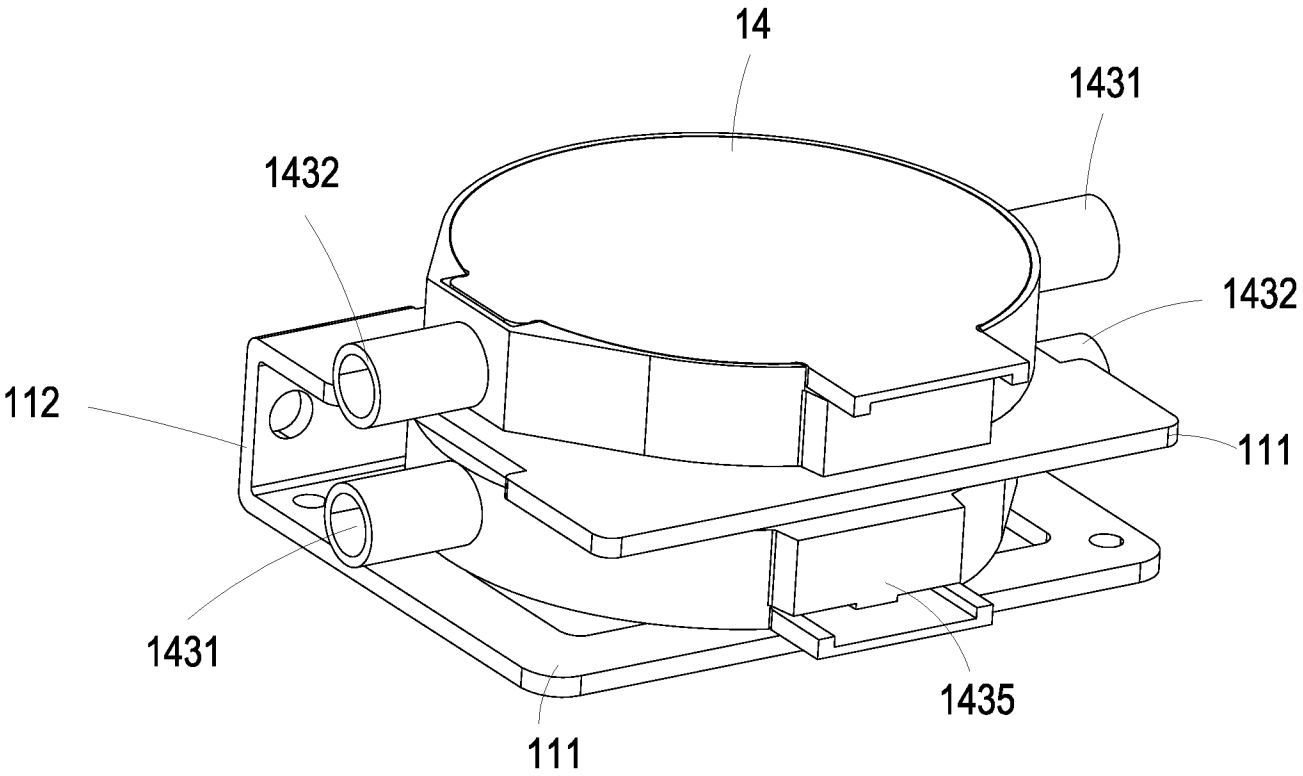
FIG. 2 is a schematic view showing fluid pumps arranged in a mirror symmetrical manner according to an embodiment of the present disclosure.
Figure 4A:
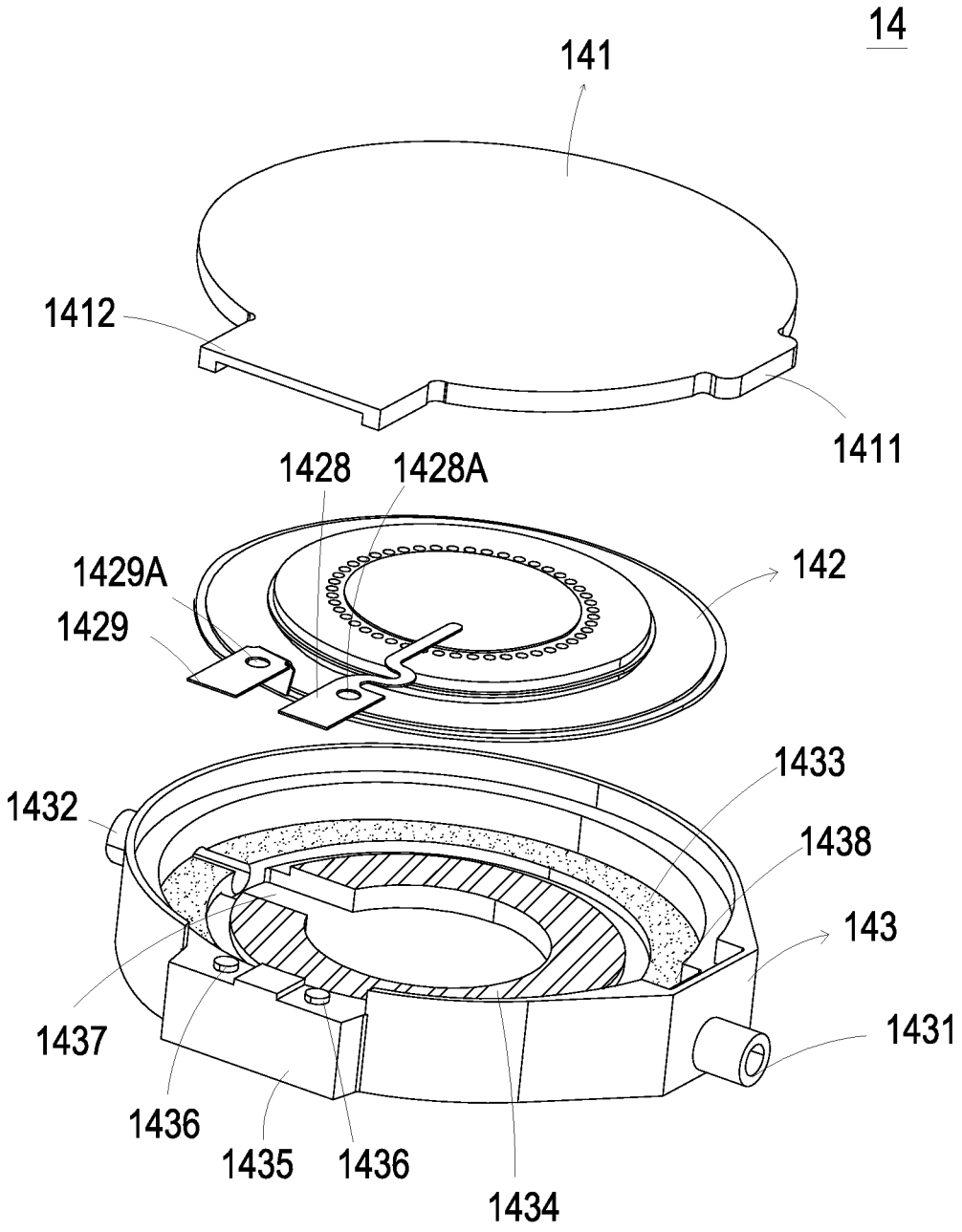
FIG. 4A a schematic exploded view showing the fluid pump according to an embodiment of the present disclosure.

Please refer to FIG. 2 and FIG. 4A. In the embodiment described above, each of the fluid pumps 14 has a flat cylindrical shape and includes a tubular disc 143, a core module 142 and a cover 141 which are sequentially stacked from bottom to top. The flowing path of the fluid pump 14 is accommodated in the tubular disc 143 for the fluid to flow in and out. The core module 142 is the power source for driving a fluid flow and is driven by the driving signal from the control board 12. The bottom surface of the cover 141 is combined with the top end of the tubular disc 143, so as to seal the core module 142 in the fluid pump 14. In one aspect of the present disclosure, since the fluid pump 14 has a flat cylindrical shape, when the two fluid pumps 14 are respectively disposed in the two accommodating spaces 113 in a mirror symmetrical arrangement to form a sandwich structure, in which one of the fluid pumps 14, one of the heat dissipation flat boards 111 and the other of the fluid pumps 14 are sequentially stacked from top to bottom, the contact areas of the cover 141 and the tubular disc 143 with the heat dissipation board assembly 11 can be maximized. Therefore, the heat dissipation efficiency for the core module 142 in the fluid pump 14 can be optimized during operation, thereby avoiding the problem that the operation efficiency of the core module 142 is lowered due to the rising temperature derived from poor heat dissipation after the fluid pump 14 is operated for a period of time. Furthermore, in another aspect of the present disclosure, since the two fluid pumps 14 are arranged in a mirror symmetrical manner, when the two fluid pumps 14 are operating at the same time, the vibration peaks of one of the fluid pumps 14 can counteract the vibration valleys of the other of the fluid pumps 14, so as to make the operation of the fluid pump module 1 more stable which not only elongates the life time of the fluid pump module 1, but also reduces the power consumption of the fluid pumps 14 during operation. In addition, when the fluid pump module 1 of the present disclosure is adapted to the healthcare and biochemical devices (such as the electric breast pump mentioned above) or other devices with special requirements with smooth operation, the good heat dissipation capability and the stable operation performance of the present fluid pumps 14 can also provide the user a better using experience, thereby achieving the purpose of improving the configuration of the conventional fluid transportation device while ensuring the sufficient fluid flow supplement.

Figure 3A:
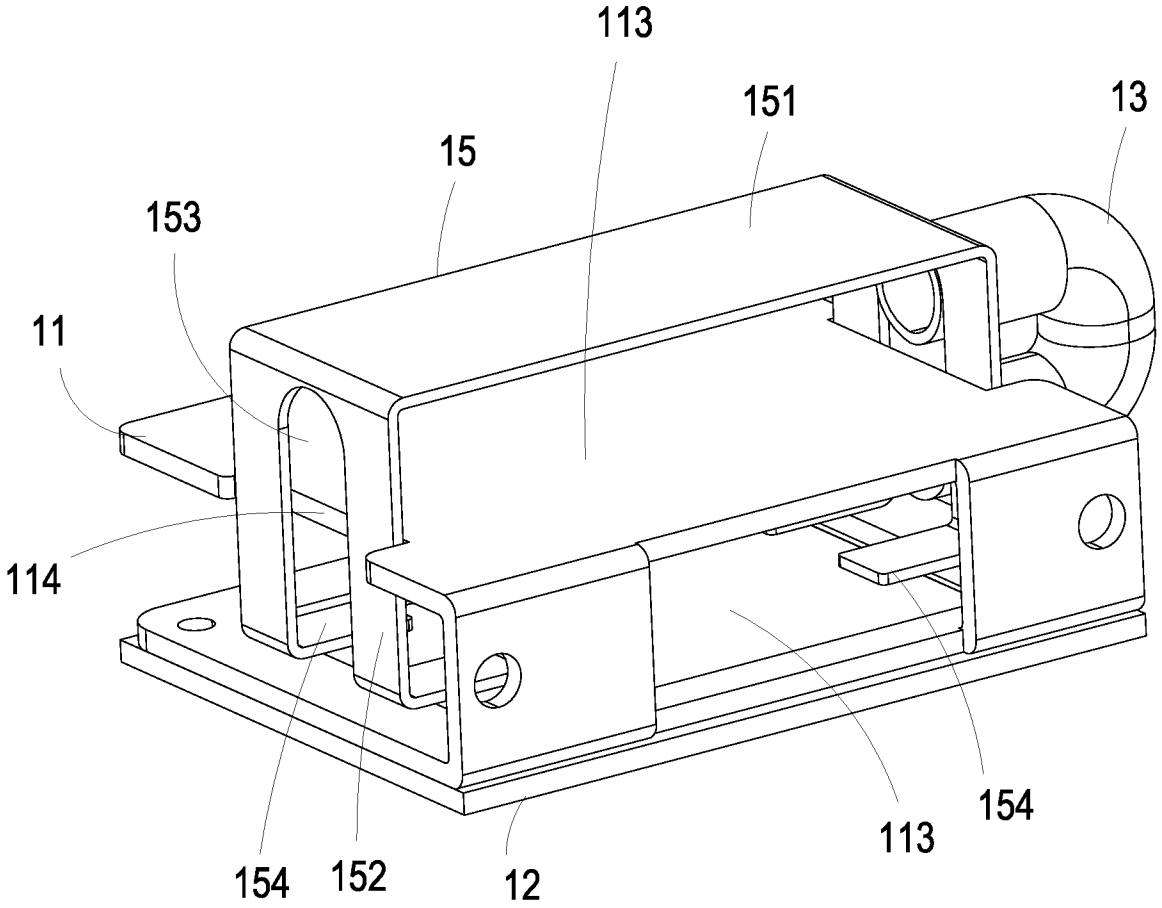
FIG. 3A is a schematic view showing the fixing configuration of the fluid pump module formed by a fixing frame body, a heat dissipation board assembly, a controlling board and a conveying pipe according to an embodiment of the present disclosure.
Figure 3B:
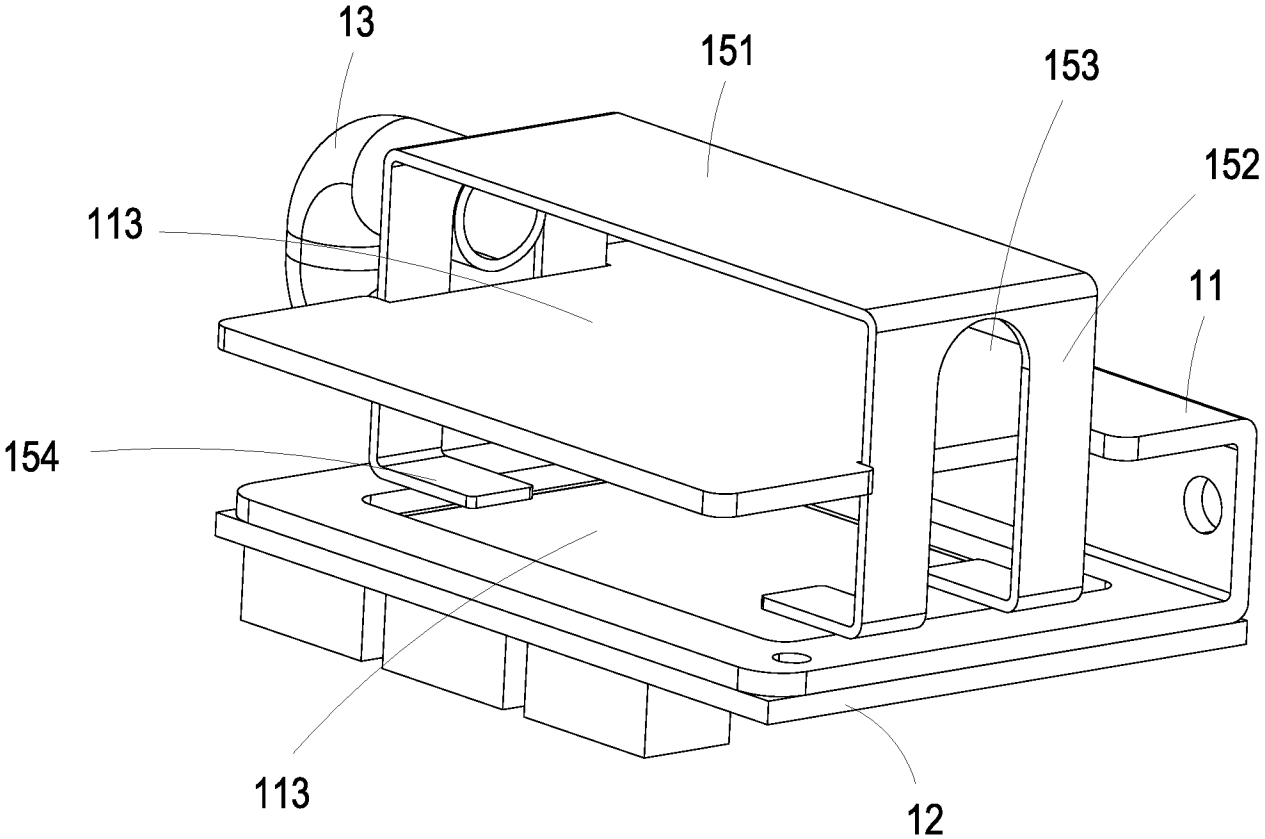
FIG. 3B is a schematic view showing the fixing configuration of the fluid pump module formed by the fixing frame body, the heat dissipation board assembly, the controlling board and the conveying pipe from another view angle according to the embodiment of the present disclosure.

Please refer to FIG. 3A and FIG. 3B. The fixing frame body 15 includes a frame body flat board 151, frame body side walls 152, frame body openings 153 and frame body fixing elements 154. The frame body flat board 151 is located at the top of the fixing frame body 15. The frame body side walls 152 are perpendicularly disposed at two opposite ends of the frame body flat board 151, and the frame body fixing elements 154 are disposed at ends of the frame body side walls 152 opposite to the frame body flat board 151, so as to form a "⊓" shape structure. In an embodiment, the fixing frame body 15 is fixed on the heat dissipation board assembly 11 through engaging the frame body side walls 151 in indentations 114 provided at two opposite ends of the upper layer of the heat dissipation board assembly 11 and fixing the frame body fixing elements 154 located at the ends of the frame body side walls 152 on the lower layer of the heat dissipation board assembly 11, so as to form the accommodating spaces 113 for disposing the fluid pumps 14 therein. Moreover, the frame body openings 153 are respectively provided on the frame body side walls 152 for allowing the conveying pipe 13 to extend out and serially connect the two fluid pumps 14. Notably, in the present disclosure, the optimal amount of the fluid pumps 14 is two, and accordingly, the fluid pump module 1 provides two accommodating spaces 113 in this embodiment. However, one skilled in the art would understand that the amount of the fluid pumps 14 may be increased in accordance with the practical demands, and for accommodating more fluid pumps 14, the amount of the accommodating spaces 113 also may be increased through modifying the heat dissipation board assembly 11, for example, increasing the number of the heat dissipation flat boards 111 to provide more accommodating spaces 113 and thus accommodate more fluid pumps 14.

Please further refer to FIG. 4A. In an embodiment of the present disclosure, the tubular disc 143 includes an inflow tube 1431, an outflow tube 1432 at the opposite side of the inflow tube 1431, and a protrusion portion 1435 located between the inflow tube 1431 and the outflow tube 1432. Within the region surrounding by the inflow tube 1431, the outflow tube 1432 and the protrusion portion 1435, an inflow annular layer 1433 is disposed. The inflow annular layer 1433 includes a notch which is in communication with the outflow tube 1432, and a fluid inlet 1438, which is in communication with the inflow tube 1431, is located at a position above the inflow annular layer 1433 opposite to the notch. Within the inflow annular layer 1433, an outflow annular layer 1434 is disposed. The outflow annular layer 1434 includes a fluid outlet 1437 which is in communication with the notch of the inflow annular layer 1433 and the outflow tube 1432. The protrusion portion 1435 of the tubular disc 143 includes a plurality of positioning latches 1436. Moreover, the core module 142 includes a first electrode 1428 and a second electrode 1429, wherein the first electrode 1428 includes a first electrode positioning hole 1428A for engaging with one of the positioning latches 1436 on the protrusion portion 1435, and the second electrode 1429 includes a second electrode positioning hole 1429A for engaging with another positioning latch 1436 on the protrusion portion 1435. Furthermore, the cover 141 includes a first cover protrusion 1411 and a second cover protrusion 1412. The cover 141 is engaged and fixed with the tubular disc 143, so as to dispose the core module 142 between the tubular disc 143 and the cover 141, and the position of the first cover protrusion 1411 is corresponding to the fluid inlet 1438 and the position of the second cover protrusion 1412 is corresponding to the protrusion portion 1435.

According to an embodiment of the present disclosure, in order to optimize the dimension of the fluid pump 14 and the flow rate of the fluid driven thereby, so as to drive a maximal amount of flow with a smaller volume the fluid pump module 1, a total length of the fluid pump 14 without the inflow tube 1431 and the outflow tube 1432 is within a range of 28 mm±10 mm, a total width of the fluid pump 14 is within a range of 31 mm±10 mm, and a thickness of the fluid pump 14 is within a range of 5 mm±2 mm. Through the design of the dimension of the fluid pump 14, an output pressure of the fluid pump 14 is within a range of 150 mmHg±50 mmHg, and an output flow rate of the fluid pump 14 is within a range of 1000 ml/min±300 ml/min In accordance with one aspect of the present disclosure, the total length, the total width and the total thickness of the fluid pump 14 and the lengths and diameters of the inflow tube 1431 and the outflow tube 1432 mentioned above are only illustrated as an example which can be modified based on the requirements of the device adopting the fluid pump 14 and are still within the scope of the present disclosure.

Accordingly, the length of any one of the inflow tube 1431 and the outflow tube 1432 of the fluid pump 14 is equal to or less than 6 mm, and the diameter of any one of the inflow tube 1431 and the outflow tube 1432 of the fluid pump 14 is equal to or less than 5 mm. Moreover, a hardness of the cover 141 of the fluid pump 14 is greater than 333 MPa based on Brinell scale (according to the test standard in ISO2039-1). The material of the cover 141 is a heat conductive material or an aluminum alloy material. Notably, the hardness of the material of the cover 141 should be sufficient to resist the force caused by the vacuum formed during the fluid pump 14 is operating. If the hardness of the cover 141 is insufficient, the fluid pump 14 may collapse inwardly, thereby influencing the output efficacy of the fluid pump 14 and resulting in interferences and collisions between internal mechanisms of the fluid pump 14. In addition, the material of the cover 141 can be a metal material (such as the aluminum alloy). The metal material which is the heat conductive material provides a thermal conduction effect, so that the overall heat dissipation capability of the fluid pump 14 can be enhanced. A better heat dissipation capability for the fluid pump 14 is helpful for maintaining the performance of the fluid pump 14 at a desired level.

According to another embodiment of the present disclosure, the length of any one of the inflow tube 1431 and the outflow tube 1432 of the fluid pump 14 is equal to or more than 2.5 mm, and the diameter of any one of the inflow tube 1431 and the outflow tube 1432 of the fluid pump 14 is equal to or more than 2.5 mm. Furthermore, the hardness of the cover 141 of the fluid pump 14 is greater than 333 MPa based on Brinell scale (according to the test standard in ISO2039-1). The material of the cover 141 is a heat conductive material or an aluminum alloy material. Notably, the hardness of the material of the cover 141 should be sufficient to resist the force caused by the vacuum formed during the fluid pump 14 is operating. If the hardness of the cover 141 is insufficient, the fluid pump 14 may collapse inwardly, thereby influencing the output efficacy of the fluid pump 14 and resulting in interferences and collisions between internal mechanisms of the fluid pump 14.

Figure 4B:
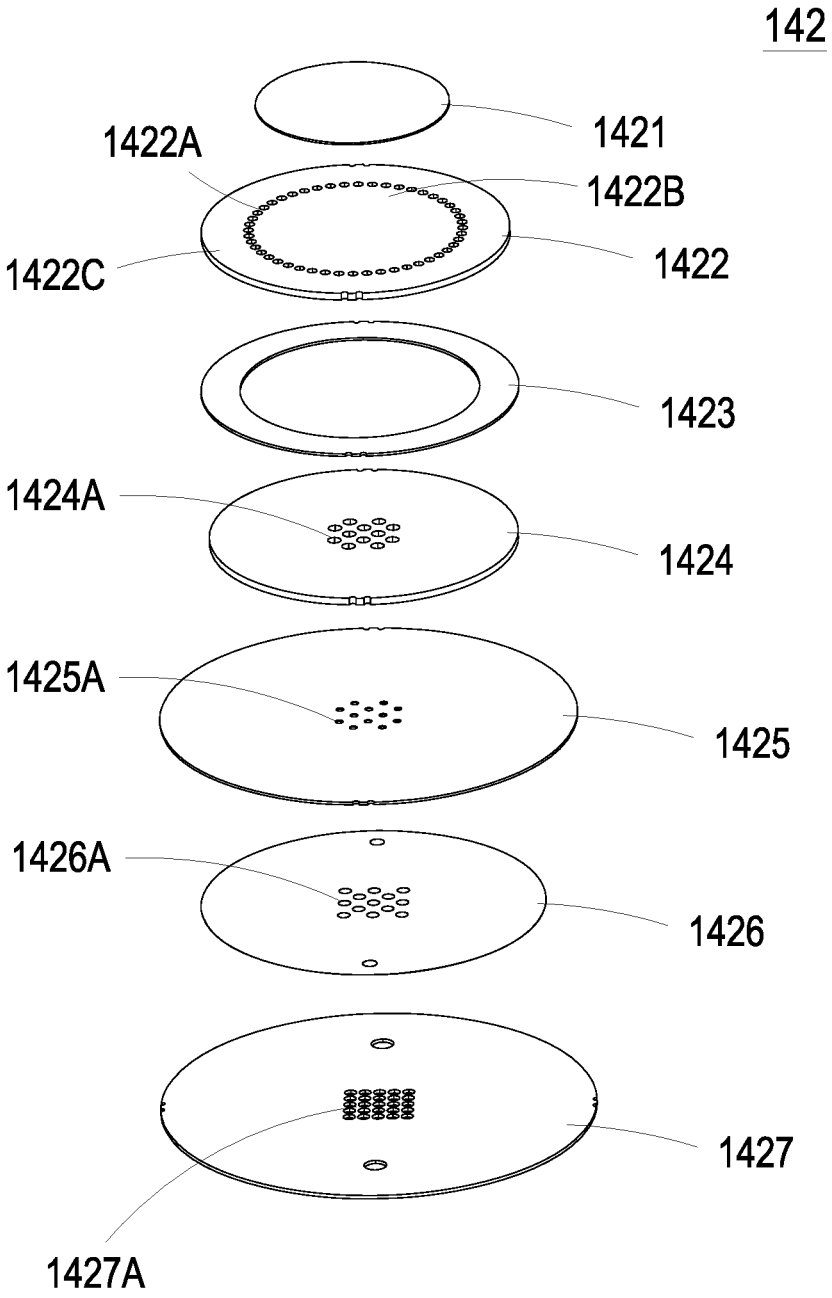
FIG. 4B is a schematic exploded view showing a core module according to an embodiment of the present disclosure.

Please refer to FIG. 4A and FIG. 4B. According to an embodiment of the present disclosure, the core module 142 includes a first electrode 1428 and a second electrode 1429. The first electrode 1428 includes a first electrode positioning hole 1428A for engaging and fixing on one of the positioning latches 1426 on the protrusion portion 1435 of the tubular disc 143. The second electrode 1429 includes a second electrode positioning hole 1429A for engaging and fixing on another positioning latch 1426 on the protrusion portion 1435 of the tubular disc 143. Notably, the protrusion portion 1435 of the tubular disc 143 is made of PC (Polycarbonate) material which is regarded as insulation material, thereby the first electrode 1428 and the second electrode 1429 would not short circuit. Further, it is noted that the core module 142 can be a fluid pump 14 or a piezoelectric fluid pump, but not limited thereto. The core module 142 can be any kind of pump capable of conveying the fluid without departing from the scope of the present disclosure.

According to the present disclosure, the cover 141 includes a first cover protrusion 1411 and a second cover protrusion 1412. The cover 141 is fixed and engaged with the tubular disc 143 so as to dispose the core module 142 between the tubular disc 143 and the cover 141. The first cover protrusion 1411 is correspondingly disposed at a position above the fluid inlet 1438, and the second cover protrusion 1412 is disposed at a position corresponding to the protrusion portion 1435. Notably, after the first cover protrusion 1411 seals with the tubular disc 143, the fluid inlet 1438 is formed between the first cover protrusion 1411 of the cover 141 and the inflow annular layer 1433. More specifically, the fluid inlet 1438 is located between the first cover protrusion 1411 and the core module 142, which is located above the inflow annular layer 1433, so that when the core module 142 is operating, the fluid is inhaled into the fluid pump 14 through the fluid inlet 1438 via the inflow tube 1431, is conveyed from a space above the core module 142 to a space below the core module 142, passes through the fluid outlet 1437 and the notch of the inflow annular layer 1433, and then is exhaled out of the fluid pump 14 through the outflow tube 1432. Notably, although the second cover protrusion 1412 of the cover 141 is sealed with the protrusion portion 1435 of the tubular disc 143, the second cover protrusion 1412 does not contact with the first electrode 1428 and/or the second electrode 1429 of the core module 142, thereby preventing from short circuits therebetween. Alternatively, a sealant or an insulating glue also can be applied between the first electrode 1428 or the second electrode 1429 and the second cover protrusion 1412, so as to avoid the first electrode 1428 and/or the second electrode 1429 from contacting with the second cover protrusion 1412 and short circuits as the core module 142 is operating.

Please refer to FIG. 4B which is a schematic exploded view showing the core module of the present disclosure. In the embodiment, the core module 142 is encased by the cover 141 and the tubular disc 143 and driven by the control board 12 through a circuit loop formed by the first electrode 1428 and the second electrode 1429. The core module 142 includes a piezoelectric sheet 1421, an inflow plate 1422, a frame 1423, a second plate element 1424, a first plate element 1425, a valve sheet 1426 and an outflow plate 1427 which are sequentially stacked from top to bottom. According to the present disclosure, the frame 1423 is disposed on the second plate element 1424, the second plate element 1424 is fixed on the first plate element 1425, the first plate element 1425 includes first through holes 1425A disposed thereon, the second plate element 1424 includes second through holes 1424A disposed thereon, and a thickness of the second plate element 1424 is greater than a thickness of the first plate element 1425. A plurality of second through holes 1424A are provided on the second plate element 1424 and a plurality of first through holes 1425A are provided on the second plate element 1425, and the amounts, positions, and diameters of the second through holes 1424A are corresponding to those of the first through holes 1425A. In this embodiment, the diameter of the second through holes 1424A and the diameter of the first through holes 1425A are identical. Further, the second plate element 1424 also includes a connection point (not shown) for electrically connecting with a conductive wire. In one aspect of this embodiment, the second plate element 1424 is a metal plate.

Please further refer to FIG. 4B. The inflow plate 1422 includes a plurality of inflow apertures 1422A, and the inflow apertures 1422A are arranged in a shape on the plane of the inflow plate 1422. In an embodiment of the present disclosure, the inflow apertures 1422A are arranged in a circular shape. Through the arranged shape of the inflow apertures 1422A, an actuation region 1422B and a stationary region 1422C are respectively defined on the inflow plate 1422. The actuation region 1422B is enclosed by the inflow apertures 1422A and is driven by the deformation of the piezoelectric sheet 1421 to move upwardly and downwardly. The stationary region 1422C is outside the inflow apertures 1422A and is used to maintain the position of the inflow plate 1422 in the core module 142. Each of the inflow apertures 1422A mentioned above has a tapered shape for enhancing the inflow efficiency which is easy for flowing-in and difficult for flowing-out, so as to prevent the backflow of the fluid. The amount of the inflow apertures 1422A is even. In one of the embodiments, the amount of the inflow apertures 1422A is 48, and in another embodiment, the amount of the inflow apertures 1422A is 52, but not limited thereto. Besides, the arranged shape of the inflow apertures 1422A can be different, such as a rectangular shape, a square shape, or a circular shape, but not limited thereto.

The piezoelectric sheet 1421 mentioned above has a shape of circular. The piezoelectric sheet 1421 is disposed on the actuation region 1422B of the inflow plate 1422 and the shape thereof is corresponding to the actuation region 1422B. In this embodiment, the inflow apertures 1422A are arranged in a circular shape, so that the actuation region 1422B is defined as a circular shape, and the piezoelectric sheet 1421 also has a circular shape. As described above, the arranged shape of the inflow apertures 1422A can be rectangle, square or circle. When the shape of the actuation region 1422B varies as the arranged shape of the inflow apertures 1422A changes, the shape of the piezoelectric sheet 1421 should also be changed accordingly. In one embodiment of the present disclosure, the inflow apertures 1422A are arranged in a circular shape to match up with the piezoelectric sheet 1421 having a circular shape, and accordingly, the appearance of the core module 142 is also set up in a circular shape.

According to the present disclosure, when the piezoelectric sheet 1421 receives the driving signal (a driving voltage and a driving frequency), the electrical energy is converted into the mechanical energy through the converse piezoelectric effect, wherein a deformation level of the piezoelectric sheet 1421 is controlled by the level of the driving voltage, and a deformation frequency of the piezoelectric sheet 1421 is controlled by the driving frequency. The core module 142 is driven to convey the fluid through the deformation of the piezoelectric sheet 1421. When the actuation region 1422B of the inflow plate 1422 bends upwardly, the valve sheet 1426 is drawn upwardly to seal the first through holes 1425A of the first plate element 1425, and at this moment, the fluid is inhaled into the core module 142 through the inflow apertures 1422A. Then, when the piezoelectric sheet 1421 deforms again upon receiving the driving signal, the actuation region 1422B of the inflow plate 1422 is driven to bend downwardly, and the fluid in the core module 142 flows downwardly and passes through the second through holes 1424A of the second plate element 1424 and the first through holes 1425A of the first plate element 1425 at the same time. The valve sheet 1426 is pushed and displaced through the motive energy of the downwardly flowed fluid, so that the valve sheet 1426 departs from the first through holes 1425A and abuts against the outflow plate 1427, thereby opening a flowing path and exhaling the fluid through the outflow aperture 1427A. As a result, in the core module 142, the fluid pump 14 can achieve the effect of driving a large amount of fluid flow through driving the inflow plate 1422 to bend in a reciprocating manner by the piezoelectric sheet 1421.

In summary, in the core module 142 of the fluid pump 14 in present disclosure, the effect of driving a large amount of fluid flow by the fluid pump 14 is achieved through sequentially disposed and stacked the piezoelectric sheet 1421, the inflow plate 1422, the frame 1423, the second plate element 1424, the first plate element 1425, the valve sheet 1426 and the outflow plate 1427. Furthermore, through arranging the fluid pumps 14 opposite to each other in a mirror symmetrical manner with the heat dissipation board assembly 11 disposed therebetween for fixing the fluid pumps 14 so as to form a sandwich structure sequentially stacking one of the fluid pumps 14, the heat dissipation board assembly 11 and the other fluid pump 14 from top to bottom, not only the heat produced by the fluid pump module 1 during operation can be effectively dissipated, the actuation procedure of the core module 142 also can be more stable. Therefore, the life time of the fluid pump module 1 can be elongated, and the power consumption of the fluid pumps 14 also can be reduced, thereby improving the devices adopting the technology of fluid transportation in the present disclosure in fields of industrial applications, biomedical applications, and healthcare.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A fluid pump module, comprising:

a heat dissipation board assembly;

a fixing frame body fixed at one side of the heat dissipation board assembly, so as to form two accommodating spaces between the heat dissipation board assembly and the fixing frame body;

two fluid pumps respectively disposed in the two accommodating spaces;

a control board disposed at another side of the heat dissipation board assembly; and a conveying pipe connected between the two fluid pumps so as to connect the two fluid pumps in series, wherein the control board controls operations of the two fluid pumps, and the heat dissipation board assembly dissipates heats produced by a module formed by the two fluid pumps, wherein the fixing frame body further comprises a frame body flat board, frame body side walls, frame body openings and frame body fixing elements, wherein the frame body flat board is located at the top of the fixing frame body, the frame body side walls are perpendicularly disposed at two opposite ends of the frame body flat board, and the frame body fixing elements are disposed at ends of the frame body side walls opposite to the frame body flat board, wherein the fixing frame body is fixed in indentations at opposite ends of the heat dissipation board assembly through the frame body side walls and the frame body fixing elements are fixed on the heat dissipation board assembly, so that the two fluid pumps are disposed in the accommodating spaces, and wherein the conveying pipe penetrates the frame body openings to connect with the two fluid pumps.

2. The fluid pump module as claimed in claim 1, wherein the heat dissipation board assembly further comprises:

a plurality of heat dissipation flat boards; and a heat dissipation lateral board, wherein ends at the same side of the plurality of heat dissipation flat boards are connected with the heat dissipation lateral board, so as to form the two accommodating spaces between the heat dissipation board assembly and the fixing frame body.

3. The fluid pump module as claimed in claim 2, wherein at least one of the heat dissipation flat boards is sandwiched and contacted between the two fluid pumps so as to form a sandwich structure.

4. The fluid pump module as claimed in claim 1, wherein each of the fluid pumps has a flat cylindrical shape and comprises:

a tubular disc, a core module and a cover;

wherein the tubular disc, the core module and the cover are sequentially stacked from bottom to top, the tubular disc is provided for accommodating a flowing path of the fluid pump, the core module is driven by the driving signal received from the control board to drive a fluid flow, and a bottom surface of the cover is combined with a top end of the tubular disc so as to seal the core module in the fluid pump.

5. The fluid pump module as claimed in claim 4, wherein the tubular disc further comprises:

an inflow tube;

an outflow tube disposed at an opposite side of the inflow tube; and a protrusion portion located between the inflow tube and the outflow tube, wherein an inflow annular layer is disposed within a region surrounding by the inflow tube, the outflow tube and the protrusion portion, the inflow annular layer comprises a notch which is in communication with the outflow tube, and a fluid inlet is located at a position above the inflow annular layer and is in communication with the inflow tube;

an outflow annular layer is disposed within the inflow annular layer, and the outflow annular layer comprises a fluid outlet which is in communication with the outflow tube;

the protrusion portion comprises a plurality of positioning latches;

the core module comprises a first electrode and a second electrode, wherein the first electrode comprises a first electrode positioning hole for engaging and fixing with one of the positioning latches, and the second electrode comprises a second electrode positioning hole for engaging and fixing with another positioning latch on the protrusion portion; and the cover comprises a first cover protrusion and a second cover protrusion, wherein when the cover is engaged and fixed with the tubular disc, the first cover protrusion is correspondingly disposed above the fluid inlet, and the second cover protrusion is disposed in corresponding to the protrusion portion.

6. The fluid pump module as claimed in claim 5, wherein a total length of the fluid pump without the inflow tube and the outflow tube is within a range of 28 mm±10 mm, a total width of the fluid pump is within a range of 31 mm±10 mm, and a thickness of the fluid pump is within a range of 5 mm±2 mm.

7. The fluid pump module as claimed in claim 5, wherein an output pressure of the fluid pump is within a range of 150 mmHg±50 mmHg, and an output flow rate of the fluid pump is within a range of 1000 ml/min±300 ml/min.

8. The fluid pump module as claimed in claim 5, wherein a length of any one of the inflow tube and the outflow tube is equal to or less than 6 mm, and a diameter of any one of the inflow tube and the outflow tube is equal to or less than 5 mm.

9. The fluid pump module as claimed in claim 5, wherein a length of any one of the inflow tube and the outflow tube is equal to or more than 2.5 mm, and a diameter of any one of the inflow tube and the outflow tube is equal to or more than 2.5 mm.

10. The fluid pump module as claimed in claim 4, wherein a hardness of the cover is greater than 333 MPa based on Brinell scale, and a material of the cover is a heat conductive material or an aluminum alloy material.

11. The fluid pump module as claimed in claim 4, wherein the core module further comprises a piezoelectric sheet, an inflow plate, a frame, a second plate element, a first plate element, a valve sheet and an outflow plate which are sequentially stacked from top to bottom, and wherein the frame is disposed on the second plate element, the second plate element is fixed on the first plate element, and a thickness of the second plate element is greater than a thickness of the first plate element.

12. The fluid pump module as claimed in claim 11, wherein at least one first through hole is disposed on the first plate element, at least one second through hole is disposed on the second plate element, and an amount, a position, and a diameter of the at least one second through hole are corresponding to those of the at least one first through hole.

13. The fluid pump module as claimed in claim 12, wherein the inflow plate comprises a plurality of inflow apertures, and the plurality of inflow apertures are arranged in a shape on a plane of the inflow plate, and wherein a region enclosed by the plurality of inflow apertures is defined as an actuation region, which is driven by the deformation of the piezoelectric sheet to move upwardly and downwardly, and a region outside the inflow apertures is defined as a stationary region, which is used to dispose the inflow plate in the core module.

14. The fluid pump module as claimed in claim 13, wherein the shape of the plurality of inflow apertures arranged is one selected from the group consisting of a rectangle, a square, and a circle.

15. The fluid pump module as claimed in claim 13, wherein when the piezoelectric sheet receives the driving signal to deform and the actuation region is bent upwardly, the valve sheet is drawn upwardly to seal the at least one first through hole, and the fluid is inhaled into the core module through the inflow aperture at the same time, and when the actuation region is bent downwardly, the fluid flows downwardly to pass through the at least one second through hole and the at least one first through hole, push the valve sheet to depart from the at least one first through hole, and exhale through the outflow aperture.

* * * * *